US006869237B2

(12) United States Patent
Dinca et al.

(10) Patent No.: US 6,869,237 B2
(45) Date of Patent: Mar. 22, 2005

(54) COMPENSATING MECHANICAL IMAGE STRETCH IN A PRINTING DEVICE

(75) Inventors: Laurian Dinca, Eagle, ID (US); Jamison Slippy, Sandpoint, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/364,767

(22) Filed: Feb. 11, 2003

(65) Prior Publication Data

US 2004/0155948 A1 Aug. 12, 2004

(51) Int. Cl.[7] ..... B41J 19/76
(52) U.S. Cl. ..... 400/76; 400/578
(58) Field of Search ..... 101/483, 485; 400/76, 578; 347/262, 264, 139, 140

(56) References Cited

U.S. PATENT DOCUMENTS 5,309,205 A * 5/1994 Hayano ..... 358/448
5,748,772 A 5/1998 Moro et al.
5,801,722 A * 9/1998 Ueda et al. ..... 347/16
5,933,184 A 8/1999 Ishigami et al.
6,234,602 B1 * 5/2001 Soto et al. ..... 347/19
6,295,386 B1 * 9/2001 Ryu ..... 382/294
6,626,101 B2 * 9/2003 Kajiwara et al. ..... 101/171
2002/0054347 A1 5/2002 Ikeda
2003/0067504 A1 * 4/2003 Spurr et al. ..... 347/19

FOREIGN PATENT DOCUMENTS

EP 883278 12/1998
JP 08085242 A * 4/1996 ..... B41J/19/96

OTHER PUBLICATIONS

Machine translation of JP 08085242 to Takada from the Japanese Patent Office website.*
GB Search report dated Jun. 4, 2004.

* cited by examiner

*Primary Examiner*—Daniel J. Colilla

(57) ABSTRACT

The present invention compensates a printed image for distortions caused by mechanical image stretch. One embodiment comprises a memory configured to store compensation data, the compensation data corresponding to distortion in a printed image caused by mechanical image stretch, and a processor configured to generate a compensated image data by combining data corresponding to the image and the compensation data, and configured to communicate the compensated image data to a printing system.

12 Claims, 6 Drawing Sheets

COMPENSATING MECHANICAL IMAGE STRETCH IN A PRINTING DEVICE

TECHNICAL FIELD

The present invention is generally related to printing images and, more particularly, is related to a system and method for compensating mechanical image stretch in a printing device.

BACKGROUND

Image printing devices are configured to convert electronic information corresponding to an image and print the image on a printing medium. Nonlimiting examples of printing devices include laser printers, ink jet printers, copy machines, scanners and photographic processing machines. For convenience, the printing medium is referred to as "paper" herein. Also, the term "ink" is referred to herein as the material that is applied to the printing medium. For example, a laser printer uses a dry toner and an ink jet printer uses a liquid ink. Ink may be black and/or colored.

Image data is determined and communicated to the printing unit. The electronic image data corresponding to the image is rendered into a plurality of print lines, or raster lines, for printing by a printing device. Thus, each print or raster line corresponds to the width of the paper, and the number of print or raster lines corresponds to the length of the paper. Thus, ink is applied to the paper according to the received print or raster line information. Accordingly, a paper transport unit advances the paper across the printing unit in a step-wise fashion, such that the image is printed according to the determined print lines. The direction of paper travel is referred to herein as the "print direction" for convenience. Also, the orientation of a raster line, typically perpendicular to the print direction, is referred to herein as the "scan direction" for convenience.

Typically, printing devices employ some form of mechanical apparatus to either move the paper over the printing region of the printing unit, and/or to move portions of the printing unit over the paper. For example, a paper transport unit advances a sheet of paper in the print direction using a system of rollers and/or belts.

Furthermore, a portion of the printing unit that is designed to apply ink to the paper may be moved in proximity to the paper medium along the scan direction as a line of print (corresponding to a print line) is applied to the paper. For example, a laser printer employs a charged drum that is spinning such that particles of dry toner are applied to the paper. Thus, a mechanical drive system is used to rotate the drum. Furthermore, a system of moving mirrors may by employed to direct one or more laser beams to apply a charge corresponding to a raster line to the rotating drum.

Another example is the ink jet printer employing an ink cartridge having an ink nozzle in a printhead. The ink nozzle applies liquid ink to the paper. The printhead typically slides along a track or bar oriented perpendicular to the print direction, thereby moving the printhead along the scan direction. As the nozzle is moved along the width of the paper, ink is applied from the nozzle to produce a printed image according to the determined print lines. Thus, a mechanical drive system is used to move the ink nozzle.

Furthermore, a paper transport unit may be comprised of more than one paper transport sub-unit. For example, one paper transport sub-unit in a laser printer may advance the paper over the charged drum. Another paper transport sub-unit may advance the paper, now having applied dry toner, through the fuser unit such that the dry toner is fused to the paper. If the speed that the two sub-units move the paper are not identical, the movement of the paper over the charged drum may change, thereby inducing image distortion.

For proper printing of the image onto the paper, the operation of the mechanical systems must be accurately synchronized with the incoming stream of raster line data corresponding to the image. Such printing systems are carefully designed to ensure proper synchronization of the various mechanical drive systems with the rasterized image data. Accordingly, individual parts must be designed and manufactured to operate within very precise specifications. Component tolerances must necessarily be very small to minimize error in the operation of the mechanical drive system. Because even small errors introduced by individual components may be cumulative with the errors of other components, each individual component in the mechanical drive system must be precisely designed, manufactured and assembled. Realizing such precision is expensive in both design costs, component costs and manufacturing costs.

As the paper is moved along the print direction after a print line has been applied to the paper, the paper must move in a very precise manner for proper alignment of successive print lines. Imprecise paper movement will cause image distortion because print or raster lines may not print as desired on the paper. Due to mechanical image stretch, printed or raster lines may overlap each other, or may be spaced apart from each other. Furthermore, any error in the printing of the print lines or raster lines onto the paper, such as might be caused by an ink jet printer head being moved at an inconsistent rate will cause image distortion. For convenience, distortion in a printed image induced by a mechanical drive system is referred to herein as "mechanical image stretch" or "image stretch."

Some printing applications require a very high degree of accuracy in the reproduction of the original image on the printed medium. For example, very precise measurements of the printed object may be needed. Or, if color printing is employed, very accurate color reproduction of the original image may be required. Such accuracy exceeds the visual perception of a person. That is, a visually pleasing printed image may not be a sufficiently accurate reproduction of the original image. Furthermore, if image scaling is required (in either the print direction or the scan direction, or both directions), all portions of the image must be scaled as specified.

As an exemplary cause of error in a mechanical system, consider a roller that is not exactly round. The out-of-round portion of the roller will cause the paper speed to vary as the roller drives the paper forward. When the paper is advanced through the printing unit, the speed variation and/or deviation of the paper movement causes a distortion in the printed image because the paper is not advanced through the printing unit as designed. Many other mechanical components may introduce error in the movement of the various mechanical drive systems. Laser printer charged drums may not be exactly round. Gear teeth may be slightly out of tolerance. Servo motors controlling mirror position may not be precisely tuned to its control system. Belts or cables may be loose. One skilled in the art will appreciate that the possible sources for mechanical image stretch are endless, and that the image stretch associated with each individual printing device will be unique.

Some multi-function printing devices include an image capture unit. For example, copy machines and facsimile (FAX) machines are configured to generate image information corresponding to an image. Such image capture units employ mechanical systems which, if not precisely designed, manufactured and installed, will cause image distortion analogous to the above-described mechanical image stretch. Furthermore, a stand-alone image capture appliance, such as a scanner, may employ mechanical systems that may cause undesirable image distortion when the image is generated.

SUMMARY

The present invention provides a system and method for compensating a printed image for distortions caused by mechanical image stretch. Briefly described, in architecture, one embodiment is comprised of a memory configured to store compensation data, the compensation data corresponding to distortion in a printed image caused by mechanical image stretch, and a processor configured to generate a compensated image data by combining data corresponding to the image and the compensation data, and configured to communicate the compensated image data to a printing system.

Another embodiment is a method for compensating images, the method comprising receiving image data corresponding to an image; generating a plurality of raster lines corresponding to the received image data; receiving compensation data, the compensation data corresponding to distortion in a printed image caused by mechanical image stretch associated with at least one mechanical system; combining the image data with the compensation data; and generating compensated image data from the combined image data and the compensation data.

BRIEF DESCRIPTION OF THE DRAWINGS

The components in the drawings are not necessarily to scale relative to each other. Like reference numerals designate corresponding parts throughout the several views.

DETAILED DESCRIPTION

The present invention provides a system and method for compensating mechanical image stretch in a printing device when information corresponding to an image is printed on a print medium. Mechanical image stretch, also referred to herein as image stretch, is a distortion in a printed image caused by at least one variation and/or deviation in the operation of at least one mechanical system from its design parameters, or when mechanical sub-systems transport a print medium at different speeds. Another embodiment compensates for other sources of image distortion caused by mechanical components residing in remote devices, such as the mechanical components operating in an image capture device.

A print medium is referred to herein as "paper" for convenience. Print mediums are intended to include any of the numerous types, sizes and varieties of paper that images are printed on. For example, labels, envelopes, letterhead paper, standard size copy paper, specialty paper, photographic paper, vellum sheets, overhead slides, card stock or rolled paper are non-limiting examples of the many types of printing mediums. Furthermore, the printing medium need not be paper-based. For example, but not limited to, a print medium may include containers, signs, fabrics and other surfaces. Or, the print medium may be a surface that is etched.

For convenience, the term "ink" is referred to herein as the material that is applied to the printing medium. For example, "ink" may refer to the dry toner applied to the paper, which is then fused to the paper using heat, by a laser printer. "Ink" may also refer to the liquid ink sprayed onto the paper by an ink jet printer. "Ink" may also refer to paint applied to signs or other surfaces, dyes are applied to fabrics, and/or special solvents are applied to a material to etch away a covering layer on a substrate. "Ink" may be black and/or colored. It is intended that any device that applies a substance (the "ink") to a print media in accordance with the present invention is disclosed herein and is protected by the accompanying claims.

Figure 1:
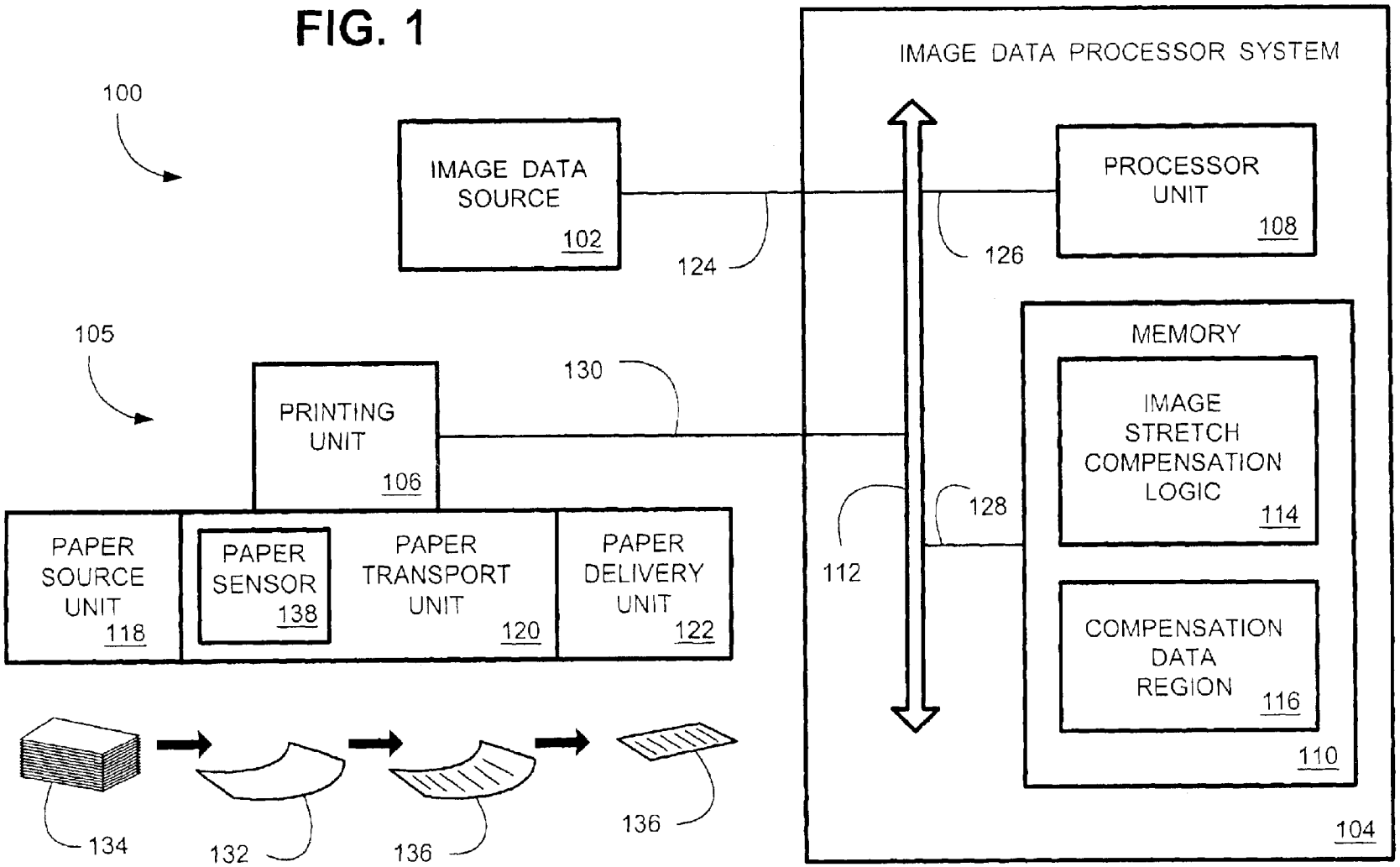
FIG. 1 is a block diagram illustrating one embodiment of a compensated printing system in accordance with the present invention.

FIG. 1 is a block diagram illustrating one embodiment of a compensated printing system 100 in accordance with the present invention. The compensated printing system 100 receives information corresponding to the image that is to be printed from image data source 102.

One embodiment of the compensated printing system 100 includes an image data processor system 104 and a printing system 105, such as a printing device. The image data processor system 104 includes a processor unit 108, a memory 110 and communication bus 112. Memory 110 includes at least the image stretch compensation logic 114 and the compensation data region 116. Associated with printing system 105, in one embodiment, is printing unit 106, paper source unit 118, paper transport unit 120 and paper delivery unit 122. In an alternative embodiment, the printing unit 106, paper source 118, paper transport unit 120 and paper delivery unit 122 are separate from the compensated printing system 100.

As described in greater detail below, images are communicated from the image data source 102, via connection 124, to image data processor system 104. Processor unit 108 compensates the image data by combining the image data with the image stretch compensation data residing in the compensation data region 116 of memory 110. As each print line is determined from the received compensated image data that is rasterized, the printing unit 106 determines compensated raster lines so that a truer image is printed by communicating compensated image data that is rasterized by printing unit 106. The compensated image data is determined by the image stretch compensation logic 114. Compensated image data is communicated to the printing unit 106, via connection 130.

In one embodiment, image stretch compensation data compensates image data so that the position of dots in a raster line along the print direction are determined in accordance with the degree of determined image distortion caused by the mechanical components residing in the paper transport mechanism 120 and/or the printing unit 106. That is, print dots may be repositioned upwards or downwards by one or more raster lines based upon the received compensated image data. Print dots may also be shifted to the right or left by one or more positions. Accordingly, the compensation data is information specifying adjustments to the image data that corresponds to the position adjustment of the dots in a compensated raster line.

One embodiment employs a unidirectional image stretch and/or image shrink algorithm implemented as part of a print driver algorithm. Such an algorithm is based upon image magnification and image reduction algorithms found in conventional copy machines. Another embodiment provides control information directly into a conventional image magnification and image reduction algorithm, thereby compensating the image data in accordance with the present invention. That is, the compensated raster line is determined from the compensated image data, thereby resulting in change in the position, spacing between and/or color of the print dots of the current raster line.

For example, variations and/or deviations in the advancement of the sheet of paper 132 through the paper transport unit 120 may cause some uncompensated raster lines to overlap by a determined amount and at a determined location on the paper during the printing of an image. Accordingly, the compensated image data, when rasterized, compensates for the effect of overlapped raster lines. Thus, generated compensated raster lines are determined from the received compensated image. Conversely, if variations and/or deviations in the advancement of the paper 132 through the paper transport unit 120 are determined such that uncompensated raster lines would be separated by a gap, compensated raster lines are determined from the received compensated image to account for the gap. Furthermore, the compensation of the raster lines may be made to selected portions of a raster line by compensating selected portions of the image data.

In one embodiment, as a sheet of paper 132 is retrieved from the paper stack 134 residing in the paper source unit 118, the sheet of paper 132 is advanced by the mechanical components (not shown) residing in the paper transport unit 120 such that the sheet of paper 132 is positioned under the printing unit 106. Ink is then applied to the sheet of paper 132. Accordingly, paper transport unit 120 advances the sheet of paper 132 in a step-wise fashion along the print direction. Because any variations and/or deviations in the advancement of the sheet of paper 132 are determined based upon received compensated image data before printing of the image, the compensated raster lines are printed thereby compensating for the variation and/or deviation. Thus, sheet of paper 132 is printed with a more accurate printing of the original image. The printed paper 136 is then transported into the paper delivery unit 122 such that the printed paper 136 may be retrieved or further processed.

In another embodiment, the raster lines are compensated in the scan direction. Thus, if the mechanical image stretch caused by the printing mechanism is in the scan direction, print lines may be determined such that a longer or shorter compensated print lines are printed. Once the magnitude of the distortion and the location of the distortion on the scan line are determined and the compensated image data is generated, a compensated print line is determined. In one embodiment, the compensation of the print line is made to at least one selected portion of the current print line. Multiple portions of the print line may be compensated differently as needed.

For example, an ink jet printer employs a print cartridge that is moved along the scan direction on a guide bar or track. The print head transport mechanism may be known to move at slightly different speeds along the guide bar or track. Thus, if the print head slows down (actual speed is less than the design speed), the corresponding portion of the raster line is compensated for that portion of the raster line. Similarly, if the print head speeds up (actual speed is greater than the design speed), the corresponding portion of the raster line is compensated. The start position or ending position where the print head begins applying print dots on the printed raster line may be adjusted. Accordingly, the compensated print line results in a printed image that more closely represents the original image data.

In an embodiment that prints color images, the raster line is compensated for color. For example, but not limited to, one embodiment of a color printing system may print up to four colored raster lines (black, cyan, yellow and/or magenta) on a single print line. Four separate mechanical sub-systems may be employed in some embodiments such that the plurality of raster lines are separately printed at the single raster line position, thereby generating a single colored raster line. Thus, coordination of the mechanical sub-systems must be precise if an accurate image is to be printed. Accordingly, image stretch compensation data that compensates for color distortions is stored in the compensation data region 116 so that a printed color image more closely represents the original image data. A colored raster line may be compensated as described above in the print direction and/or the scan direction, and/or the amount of ink may be adjusted over the length of the raster line (or one or more selected portions of the raster line) as required to provide color compensation.

Figure 7:
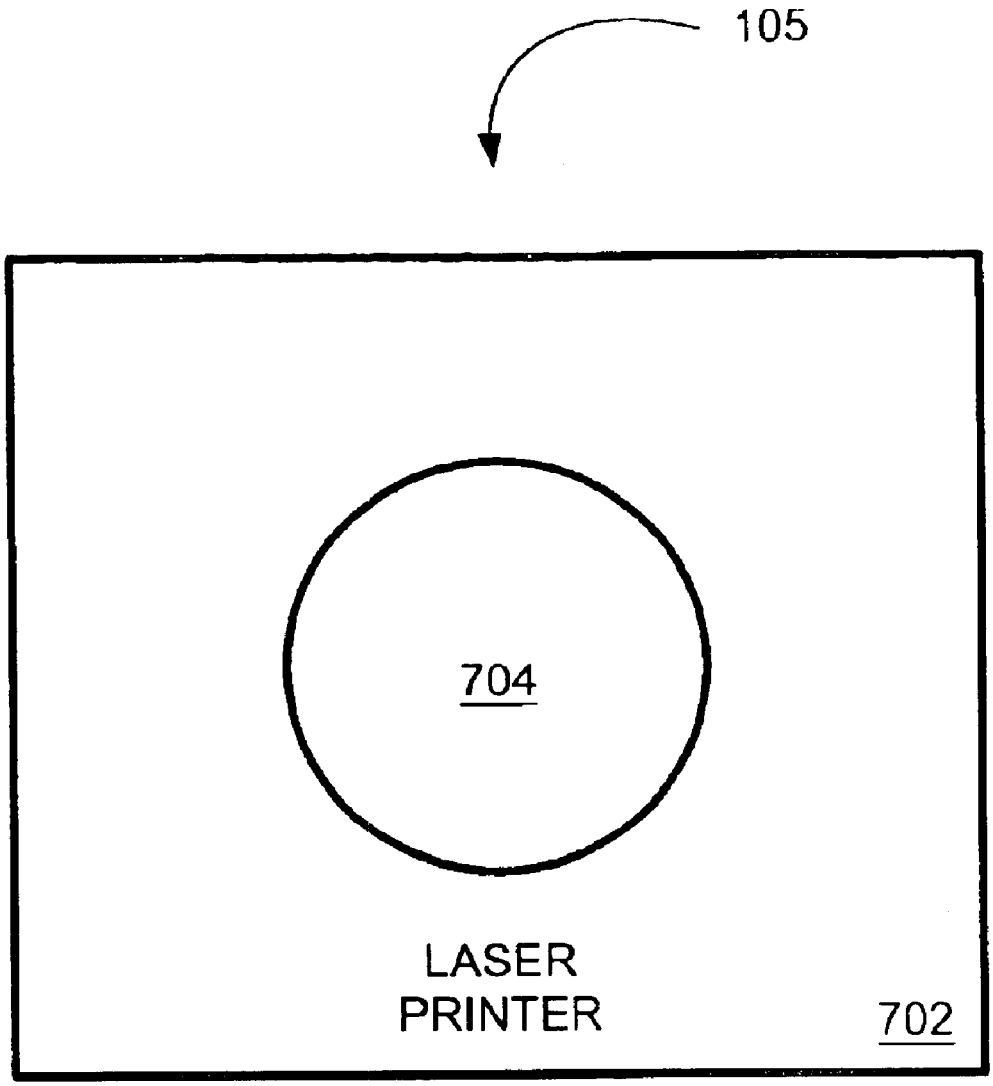
FIG. 7 is a block diagram illustrating printer components.

In yet another embodiment, mechanical systems or sub-systems residing in the printing unit 106 may cause mechanical image stretch. For example, but not limited to, the mechanical system directing the laser light to the rotating charged drum 704 in a laser printer 702 (FIG. 7) may induce mechanical image stretch. As another example, the mechanical system rotating the charged 704 drum may induce mechanical image stretch. Or, the charged drum 704 itself may have portions that are outside of design tolerances (out of round, incorrect diameter, dents, etc.). Thus, compensation data associated with the printing unit 106 is determined so that compensated image data is determined.

As described above, variations and/or deviations in the printing caused by mechanical systems or sub-systems residing in the paper transport system 120 and or the printing unit 106 are determined before printing images. These determinable variations and/or deviations allow determination of compensation data that is used to generate compensated image data, thereby generating compensated raster lines when the compensated image data is rasterized. In one embodiment, the variations and/or deviations are determined based upon the initial design parameters of the paper transport unit 120 and/or the printing unit 106. For example, but not limited to, two paper transport sub-systems residing in the paper transport system may advance the sheet of paper at slightly different speeds. When a sheet of paper is being advanced simultaneously by both mechanical sub-systems, variations and/or deviations in the movement of the sheet of paper may occur. The variation and/or deviation would be determinable based upon the design parameters of the mechanical sub-systems. Accordingly, image stretch compensation data is determined and stored in the compensation data region 116. Such compensation data may be determined from the design parameters of any mechanical system that causes mechanical image stretch.

In another embodiment, direct measurements of the variations and/or deviations in an uncompensated printed image may be made. An image or a reference image having one or more predefined reference points is captured and then printed (without compensation). That is, a reference image having known aspects and or features, such as, but not limited to, scales, geometric patterns, shapes, distances and/or colors, may be printed by the compensated printing system 100 with no compensation. The printed reference image is compared with the known reference image to determine variations and/or deviations. That is, an embodiment performs comparing a corresponding point on the printed captured image and the reference point on the reference image. Accordingly, image stretch compensation data is determined and stored in the compensation data region 116. Measuring variations and/or deviations is desirable to compensate for mechanical image stretch that varies from unit to unit so that the image stretch compensation data is uniquely determined for each unit. Such measuring could occur at the factory before the compensated printing system 100 is provided to the user. Accordingly, image stretch compensation data is determined and stored in the compensation data region 116. Compensation data may be determined by measurement for any mechanical system and/or mechanical sub-system(s) that cause mechanical image stretch.

Furthermore, measuring changes in mechanical image stretch that may occur as the compensated printing system 100 is used over time may be desirable. Thus, the image stretch compensation data could be adjusted periodically.

Another embodiment includes a paper sensor 138 conveniently located in the paper transport unit 120 such that the type and characteristics of the paper is determined. The degree of mechanical image stretch, and the corresponding image distortion, can vary depending upon the type of paper. For example, a glossy finish paper 136 may have a relatively high degree of slip with respect to rollers (not shown) that move the paper 136 through the paper transport unit 120. That is, the coefficient of friction of the paper 136 relative to the rollers is relatively low. Conversely, a thicker, softer letterhead bond paper 136 may have a lower degree of slip (higher coefficient of friction). Thus, the degree of image distortion caused by the mechanical image stretch on a glossy finish paper 136 may be different from the degree of image distortion caused by the mechanical image stretch on a letterhead bond paper 136.

Another non-limiting example of image distortion associated with paper type is the type of paper that is being printed. For example, a sheet of 8½ inch by 14 inch paper is three inches longer than standard paper (8½ by 11 inches). Accordingly, the additional three inches of the longer paper has corresponding compensation data that is not applicable to the shorter paper. Similarly, paper having different widths will have compensation data configured to compensate an image along the corresponding direction.

In this embodiment, compensation data is determined for a plurality of paper types and stored in the compensation data region 116. The paper sensor 138 detects the paper 136 and provides information to the image stretch compensation logic 114 such that the type of paper 136 is determined. Accordingly, the corresponding compensation data for the determined paper type is used to determine the compensated raster line.

For example, but not limited to, the paper sensor 138 in one embodiment detects the paper tray in the paper source unit 118 that provides the paper 136. In another embodiment, paper sensor 138 senses the paper for an identifying mark to determine the paper type. Yet another embodiment of paper sensor 138 performs a non-destructive test on the paper 136 to determine the paper type. The nature of the paper sensor 138 and the type of determination method used to identify the type of paper 136 is not intended to limit the present invention.

Figure 2:
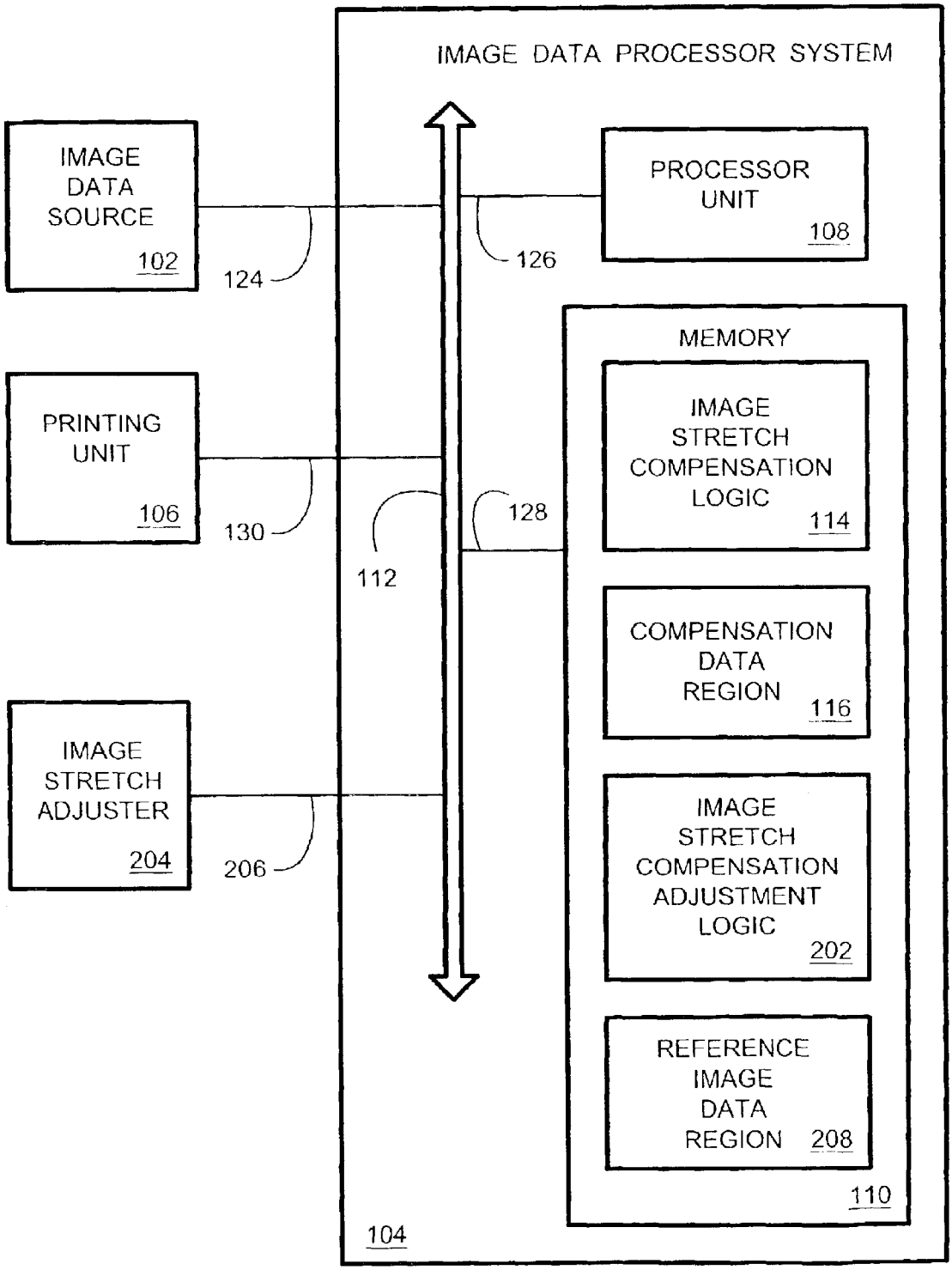
FIG. 2 is a block diagram illustrating a portion of another embodiment of a compensated printing system.

FIG. 2 is a block diagram illustrating a portion of another embodiment of a compensated printing system 100. The image stretch compensation adjustment logic 202 is provided such that the image stretch compensation data residing in the compensation data region 116 may be adjusted via image stretch adjuster 204. Such a feature is preferably selectable by the user. That is, the adjustable image stretch compensation feature is activated or deactivated by the user.

A user communicates information using image stretch adjuster 204, via connection 206, to the image data processor system 104 to adjust the image stretch compensation data. For example, the printed image may be used for documentation or scientific purposes such that the accuracy of the printed image (distance on a portion of the image, size of the image and/or color of at least a portion of the image) may be important. Accordingly, a reference image residing in the reference image data region 208 is printed and compared to a hard copy of the reference image. For example, the reference image may have very precise scales with highly accurate markings of known distances. A comparison between the printed reference image and the hard copy of the reference image would indicate variations and/or deviations in distances or size. Similarly, the hard copy of the reference image may include regions having known true colors. A comparison between the printed reference image and the hard copy of the reference image would indicate color variations and/or deviations. Once the variations and/or deviations are determined, the user, via the image stretch adjuster 204, specifies information such that the image stretch compensation data is adjusted so that a more accurate image is printed. Furthermore, an object may be used for directly comparing with the printed reference image. For example, the object may be a scale device that accurately measures distances marked on the printed reference image.

The image stretch adjuster 204 may be implemented with a variety of components. For example, but not limited to, one embodiment may employ one or more dials and/or other suitable mechanical controllers that are adjustable by the user. Another embodiment may employ a touch sensitive menu. Another embodiment may employ a keyboard device such that the user specifies the adjustments via alphanumeric commands. Implementation of the particular device for the image stretch adjuster 204 is not limiting so long as a user is able to provide information such that the image data processor system 104 determines the compensation data that results in the desired compensated raster lines.

Furthermore, the user may desire to introduce compensation data that distorts the image. For example, the user may want to adjust tone and/or color of the printed image such that the printed image or portions of the printed image is distorted from the original image. Such effects can be implemented via the image stretch adjuster 204. Accordingly, the image stretch compensation data includes both compensation for mechanically induced image stretch and compensation desired by the user.

In another embodiment, the reference image described above is provided from image data residing in the image data source 102. Such an embodiment is desirable when a plurality of different reference images are available, and/or when the image data source 102 includes an image capture device such that the reference image can be directly scanned by the image data source 102.

In an embodiment having an image data source 102 with an image capture device, a reference image may be printed and then scanned by the image capture device. The scanned printed reference image is then electronically compared with the reference image data residing in the reference image data region 208. Accordingly, mechanical image stretch caused by mechanical systems in the image capture device is determined by the image data processor system 104 such that the image stretch compensation data is calculated and stored into the compensation data region 116.

Figure 3:
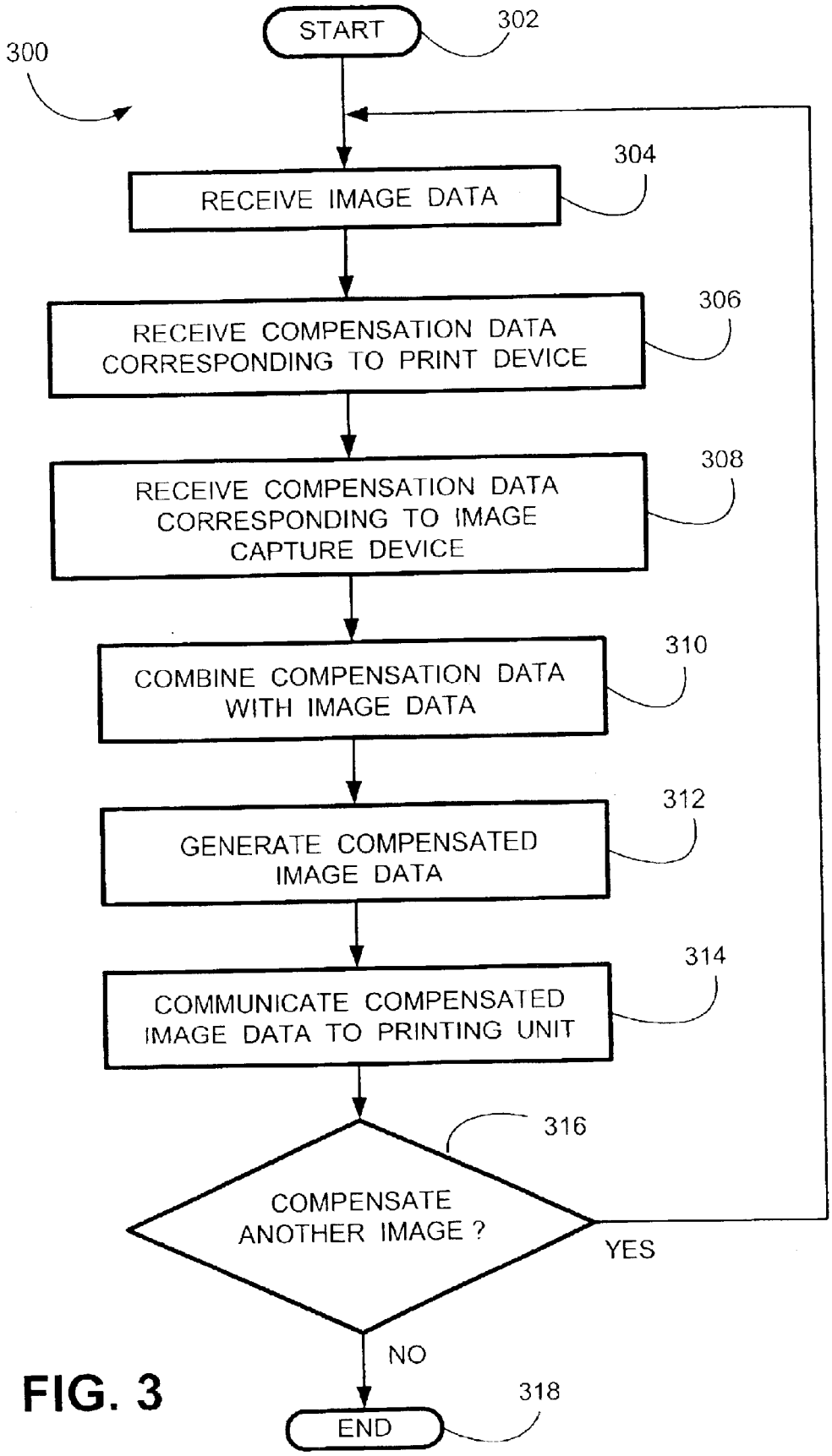
FIG. 3 is a flow chart illustrating the operation of an embodiment of the image stretch compensation logic of FIG. 1 such that a printed image is compensated for mechanical image stretch.

FIG. 3 is a flow chart 300 illustrating the operation of an embodiment of the image stretch compensation logic 114 (FIGS. 1 and 2) for compensating a printed image for mechanical image stretch. In one embodiment, the image stretch compensation logic 114 is incorporated into a print driver having a plurality of functions. In another embodiment, image stretch compensation logic 114 is implemented as a stand-alone program residing in a processing unit.

The flow chart 300 shows the architecture, functionality, and operation of a possible implementation of the software for implementing image stretch compensation logic 114. In this regard, each block may represent a module, segment, or portion of code, which comprises one or more executable instructions for implementing the specified logical function (s). It should also be noted that in some alternative implementations, the functions noted in the blocks may occur out of the order noted in FIG. 3 or may include additional functions without departing significantly from the functionality of the compensated printing system 100. For example, two blocks shown in succession in FIG. 3 may in fact be executed substantially concurrently, the blocks may sometimes be executed in the reverse order, or some of the blocks may not be executed in all instances, depending upon the functionality involved, as will be further clarified hereinbelow. All such modifications and variations are intended to be included herein within the scope of this disclosure for the compensated printing system 100.

The process starts at block 302. At block 304, data for an image is received. The data can be graphical data generated by an image capture device, textual data generated by a text processing device, or any other type of information now known or later developed that is printed by a printing device. At block 306, compensation data corresponding to the print device that will print the compensated image data is received.

Figure 4:
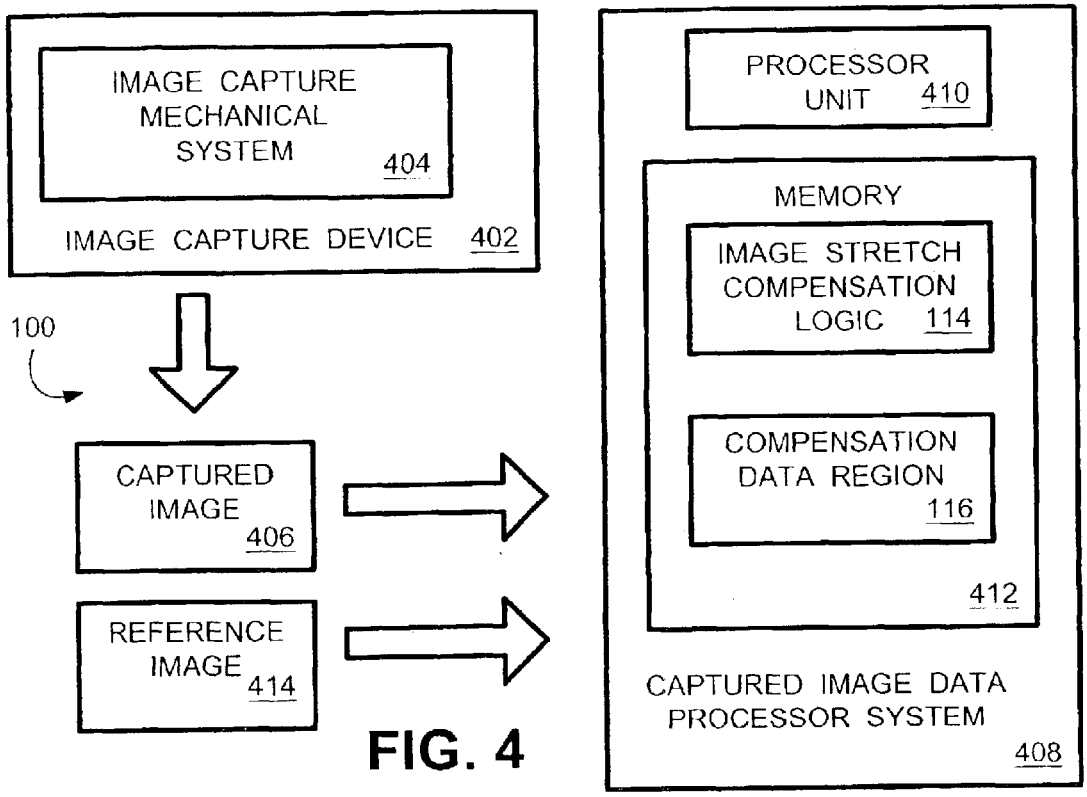
FIG. 4 is a block diagram illustrating another embodiment of a compensated printing system.
Figure 5:
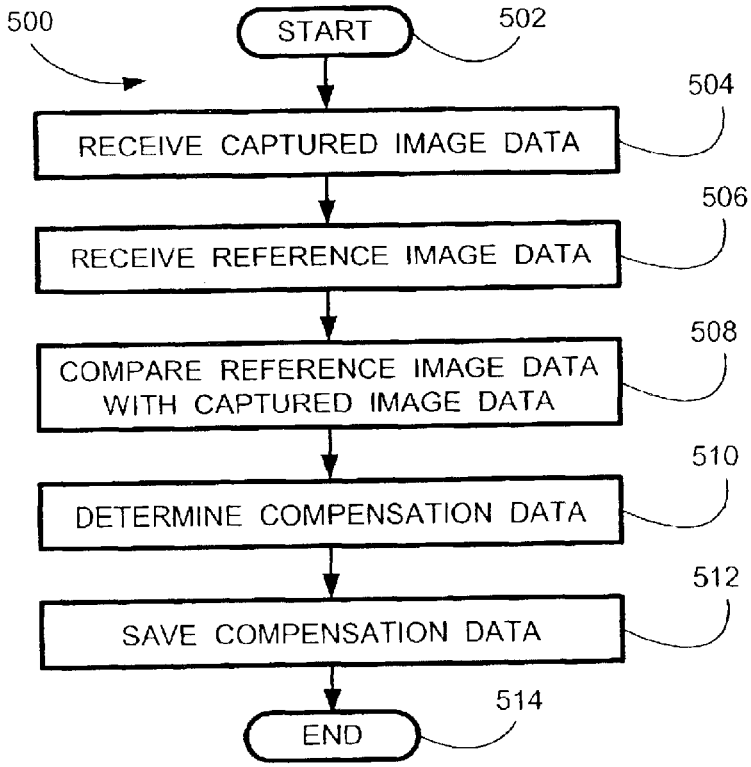
FIG. 5 is a flow chart illustrating the operation of the image stretch compensation logic of FIG. 4 such that a printed image is compensated for mechanical image stretch induced by the image capture mechanical system residing in image capture device.

Optionally, at block 308, compensation data corresponding to the image capture device that generated the original image data is received. The process proceeds to block 310 where the compensation data is combined with the received image data. The process of determining compensation data for an image capture device is described in greater detail below and is illustrated in FIGS. 4 and 5. Furthermore, in a printing system having a plurality of printers and/or a plurality of sources of images, block 306 above may include the additional processes of identifying the printer that will print the image (thereby providing for flexibility in compensating image data for the print device that is printing). Similarly, block 308 above may include the additional processes of identifying the image capture device that generated the image data (thereby providing for flexibility in compensating image data for a specific image capture device). Accordingly, compensation data corresponding to the various sources of mechanical image stretch is combined prior to block 310.

At block 312, the compensated image data is generated. At block 314, the compensated image data is communicated to the printing unit. At block 316, a determination is made whether another image is to be compensated. If so (the YES condition), the process proceeds back to block 304. Accordingly, another image is compensated. If not (the NO condition), the process proceeds to block 318 and ends.

FIG. 4 is a block diagram illustrating another embodiment of a compensated printing system 100. This embodiment of the compensated printing system 100 is configured to determine compensation data for mechanical image stretch arising in an image capture device 402 by direct measurement. Image capture device 402 includes at least an image capture mechanical system 404. Depending upon the nature of the image capture device 402, the image capture mechanical system 404 is configured to cause the scanning of an object, thereby generating a captured image of the object. For example, one embodiment of image capture device 402 employs an image capture mechanical system 404 that is configured to move one or more mirrors such that light is scanned across the object. Another exemplary embodiment of an image capture device 402 includes an image capture mechanical system 404 configured to transport the object across a light source such that the object is scanned. Examples of image capture devices 402 include, but are not limited to, copy machines, scanners or facsimile machines that are configured to capture images of objects. The nature of the image capture device 402 does not limit the practice of the present invention, as described in greater detail below.

In one embodiment, an image of a known object having predetermined features (such as units of length and/or color) is captured by the image capture device 402. That is, a captured image 406 of the referenced object is generated. The captured image 406 is communicated to the captured image data processor system 408. The captured image data processor system 408 includes a processor unit 410 and memory 412. Memory 412 further includes the above-described image stretch compensation logic 114 and the compensation data region 116 where compensation data is stored.

Reference image 414 is communicated to the captured image data processor system 408. Accordingly, the captured image 406 is compared with the reference image 414 such that the nature of any differences between the captured image 406 and the reference image 414 is determined. The comparison is made electronically in one embodiment. In another embodiment, the captured image 406 is printed (preferably with compensation according to the present invention for the print device) and then manually compared to the reference image 414. The determined differences are used to determine compensation data associated with the image capture mechanical system 404 of the image capture device 402. The determined compensation data associated with the image capture mechanical system 404 is stored in the compensation data region 116.

Accordingly, when image data associated with images captured by the image capture device 402 is communicated to printing unit 106 (FIG. 1), the communicated image data is compensated as described herein. That is, compensation data is determined by direct measurement for printing the image, thereby compensating the printed image for mechanical image stretch associated with the image capture mechanical system 404. Compensation data may be determined for either, or both, the print direction and the scan direction, as described herein.

One embodiment of the compensated printing system 100 is implemented in a multi-purpose device that includes the image capture device 402 and the captured image data processor system 408. In another embodiment, the image capture device 402 is a separate unit from the image data processor system 408. Such an embodiment is desirable if compensation data for images received from more than one image capture device 402 is to be determined and stored in the compensation data region 116.

Yet another embodiment includes the image capture device 402 and the captured image data processor system 408, plus the printing unit 106, paper source 118, paper transport unit 120 and paper delivery unit 122 of FIG. 1. As described in greater detail below, compensation data for this embodiment includes compensation for mechanical image stretch associated with both the image capture mechanical system 404, the paper transport unit 120 and/or the printing unit 106.

FIG. 5 is a flow chart 500 illustrating the operation of the image stretch compensation logic 114 (FIG. 4) such that a printed image is compensated for mechanical image stretch induced by the image capture mechanical system 404 residing in image capture device 402. In one embodiment, the image stretch compensation logic 114 is incorporated into a print driver having a plurality of functions. In another embodiment, image stretch compensation logic 114 is implemented as a stand alone program.

The flow chart 500 shows the architecture, functionality, and operation of a possible implementation of the software for implementing image stretch compensation logic 114. In this regard, each block may represent a module, segment, or portion of code, which comprises one or more executable instructions for implementing the specified logical function (s). It should also be noted that in some alternative implementations, the functions noted in the blocks may occur out of the order noted in FIG. 5 or may include additional functions without departing significantly from the functionality of the compensated printing system 100. For example, two blocks shown in succession in FIG. 5 may in fact be executed substantially concurrently, the blocks may sometimes be executed in the reverse order, or some of the blocks may not be executed in all instances, depending upon the functionality involved, as will be further clarified hereinbelow. All such modifications and variations are intended to be included herein within the scope of this disclosure for the compensated printing system 100 and to protected by the accompanying claims.

The process of compensating image data for mechanical image stretch resulting from variations and/or deviations in the image capture mechanical system 404 (FIG. 4) of an image capture device 402 starts at block 502. At block 504, captured image data of a reference object is received. At block 506, reference image data corresponding to the reference object is received. At block 508, the reference image data is compared with the captured image data. At block 510, the compensation data is determined based upon the difference between the compared reference image data and the captured image data. At block 512, the determined compensation data is saved into the compensation data region 116 of the captured image data processor system 408 (FIG. 4). The process ends at block 514.

In another embodiment, compensation data associated with the image capture mechanical system 404 is determined based upon the design of the image capture mechanical system 404. Thus, known variations and/or deviations in image capture mechanical system 404 enable the determination of compensation data.

Figure 6:
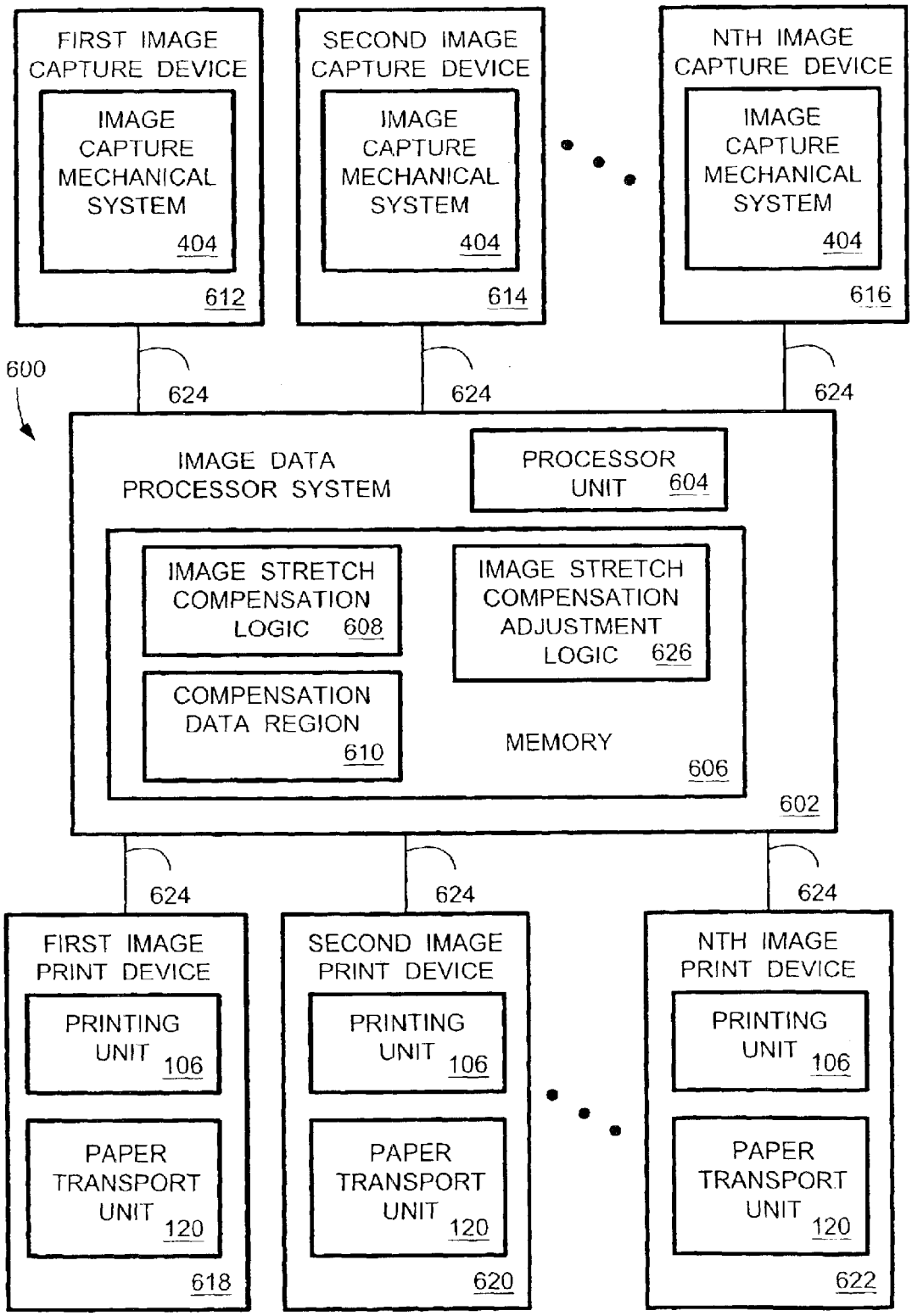
FIG. 6 is a block diagram illustrating another embodiment of a compensated printing system such that a printed image is compensated for mechanical image stretch associated with at least one selected image capture device and at least one selected image print device.

FIG. 6 is a block diagram illustrating another embodiment of a compensated printing system such that a printed image is compensated for mechanical image stretch associated with at least one selected image capture device and at least one selected image print device. Compensated printing system 600 includes the image data processor system 602. One embodiment of the image data processor system 602 is implemented in a personal computer, a network controller or other general purpose, multi-function processing system. Another embodiment of the image data processor system 602 is implemented in a specially fabricated processing unit configured for compensating images for mechanical image stretch according to the present invention.

Image data processor system 602 includes at least processor unit 604 and memory 606. Memory 606 includes at least the image stretch compensation logic 608 and the compensation data region 610. Compensation data region 610 is configured to store compensation data associated with at least one image capture device having at least one image capture mechanical system 404 (see also FIG. 4 and as described above). Similarly, compensation data region 610 is configured to store compensation data associated with at least one image print device having at least one printing unit 106 and paper transport unit 120 (see also FIG. 4 and as described above).

Preferably, image data processor system 602 is configured to couple to a plurality of image capture devices. For convenience, a first image capture device 612, a second image capture device 614 and an Nth image capture device 616 are illustrated. Similarly, image data processor system 602 is configured to couple to a plurality of print devices. For convenience, a first image print device 618, a second image print device 620 and an Nth image print device 622 are illustrated. The above listed devices are coupled to the image data processor system 602 via connections 624.

Compensation data associated with the mechanical image stretch from the image capture mechanical system 404 in the first image capture device 612, the second image capture device 614 and the Nth image capture device 616 are determined by design considerations and/or direct measurement, as described above. Similarly, compensation data associated with the mechanical image stretch from printing unit 106 and/or paper transport unit 120 in the first image print device 618, the second image print device 620 and the Nth image print device 622 are determined by design considerations and/or direct measurement, as described above. The determined compensation data is stored in the compensation data region 610 of memory 606.

The various components of FIG. 6 are described and illustrated herein for convenience. Thus, the above-described image capture devices 612, 614 and 616 may be different types of image capture devices. Accordingly, the image capture mechanical system 404 residing in each one of the image capture devices 612, 614 and 616 may be a different type of image capture mechanical system 404. Similarly, the above-described image print devices 618, 620 and 622 may be different types of image print devices. Also, the printing unit 106 and/or the paper transport unit 120 residing in each one of the image print devices 618, 620 and 622 may be a different type of printing unit 106 and/or paper transport unit 120.

When an image is to be printed, image stretch compensation logic 608 is executed. The information identifying the image capture device that generated the captured image and the image print device that has been designated to print the image is received (specified). Specification of the image capture device and/or the specified image print device may be made manually by a user, or determined electronically by the image data processor system 602. If the specified image capture device is one of the devices that have the above-described compensation data stored in the compensation data region 610 (first image capture device 612, second image capture device 614 or Nth image capture device 616), the compensation data is retrieved for the specified image capture device. Similarly, if the specified image print device is one of the devices that have the above-described compensation data stored in the compensation data region 610 (first image print device 618, second image print device 620 or Nth image print device 622), the compensation data is retrieved for the specified image print device.

Once the compensation data for the specified image capture device and the specified image print device are retrieved, the compensation data is combined. The processing of the original image data with the compensation data produces compensated image data, thereby generating compensated raster lines which are then printed by the image print device, as described in detail above for other embodiments.

If the specified image capture device is not one of the image capture devices having compensation data in the compensation data region, one embodiment compensates the image data with compensation data associated with the specified image print device. In another embodiment, compensation data associated with the specified image capture device is communicated to the image data processor system 602 such that the printed image is compensated for at least mechanical image stretch associated with the specified capture image device.

Image data processor system 602 is configured to operate in a mode where multiple images from a plurality of image capture devices are printed on a plurality of image print devices. For example, but not limited to, image data processor system 602 may be incorporated into a system configured to print magazines, advertisements and/or newspapers. Accordingly, each image is compensated for mechanical image stretch associated with the image capture device that captured the image, and each image is further compensated for mechanical image stretch associated with the image print device printing the image.

For example, consider a single sheet of paper having three printed images. In this simplified illustrative example, the first image was captured by first image capture device 612, the second image captured by the second image capture device 614 and the third image captured by the Nth image capture device 616. When a large volume of papers having the three printed images are desired, multiple image printing devices may be used to print the desired number of papers. Accordingly, papers having the three images printed by the first image print device 618 have raster lines associated with the first image compensated for mechanical image stretch associated with the first image capture device 612 and the first image print device 618, compensation data associated with the second image is determined for mechanical image stretch associated with the second image capture device 614 and the first image print device 618, and compensation data associated with the third image is determined for mechanical image stretch associated with the third image capture device 616 and the first image print device 618.

Similarly, papers having the three images printed by the second image print device 620 have compensation data associated with the first image determined for mechanical image stretch associated with the first image capture device 612 and the second image print device 620, compensation data associated with the second image determined for mechanical image stretch associated with the second image capture device 614 and the second image print device 620, and compensation data associated with the third image determined for mechanical image stretch associated with the third image capture device 616 and the second image print device 620. Likewise, papers having the three images printed by the Nth image print device 622 have compensation data associated with the first image determined for mechanical image stretch associated with the first image capture device 612 and the Nth image print device 622, compensation data associated with the second image determined for mechanical image stretch associated with the second image capture device 614 and the Nth image print device 622, and compensation data associated with the third image determined for mechanical image stretch associated with the third image capture device 616 and the Nth image print device 622.

Furthermore, if the exemplary printed page described above includes text, the compensation data associated with the printed text are determined for the image print device printing the page. Thus, text printed on the page of paper printed by the first image print device 618 is compensated for mechanical image stretch associated with the printing unit 106 and/or the paper transport unit 120 residing in the first image print device 618.

For convenience, connection 124 (FIG. 1) is illustrated as directly coupled to communication bus 112. Processor unit 108 and memory 110 are coupled to communication bus 112 via connections 126 and 128, respectively. In alternative embodiments, the above-described components are connectively coupled to processor unit 108 in a different manner than illustrated in FIG. 1. For example, one or more of the above-described components may be directly coupled to processor unit 108 or may be coupled to processor unit 108 via intermediary components (not shown).

In one embodiment, image data source 102 is included as an integral component of the compensated printing system 100. For example, the image data source 102 is a memory where images are stored such that the image data is retrieved and compensated in accordance with the present invention at the time of printing. In another embodiment, image data source 102 is an image capture device, such as a copier or facsimile (FAX) machine, configured to capture an image and configured to communicate the image data directly to the image data processor system 104. In yet another embodiment, the image data is retrieved from a remote image data source 102 having a memory and/or an image capture device.

Connections 124 (FIG. 1) and 624 (FIG. 6) are illustrated as a single connection for convenience. Additionally, connections 126 and 624 may be part of a complicated communicated network, such as the Internet, telephone system, satellite system or combination communication system, such that the image data is retrieved from the remotely located image data source 102 (FIG. 1) and/or an image capture device 612, 614 and/or 616 (FIG. 6), respectively. Accordingly, the present invention is not limited by the physical location of the image data before compensation by the image data processor system 104 (FIG. 1) and/or the image data processor system 602 (FIG. 6).

Another embodiment of image data processor system 602 includes the image stretch compensation adjustment logic 626. The image stretch compensation adjustment logic 626 operates substantially similar to the above-described image stretch compensation logic 202 (FIG. 2). However, image stretch compensation adjustment logic 626 is configured to add compensation to any image(s) printed on a specified image print device.

When image stretch compensation logic 114 (FIGS. 1 and 2), image stretch compensation adjustment logic 202 (FIG. 2), image stretch compensation logic 608 (FIG. 6), and/or image stretch compensation adjustment logic 626 (FIG. 6) is implemented as software and stored in memory 110 or 606, respectively, one skilled in the art will appreciate that logic 114, 202, 608 and/or 626 can be stored on any computer readable medium for use by or in connection with any computer and/or processor related system or method. In the context of this document, a memory 110 or 606 is a computer readable medium that is an electronic, magnetic, optical, or other physical device or means that contains or stores a computer and/or processor program. Logic 114, 202, 608 and/or 626 can be embodied in any computer readable medium for use by or in connection with an instruction execution system, apparatus, or device, such as a computer-based system, processor-containing system, or other system that can fetch the instructions from the instruction execution system, apparatus, or device and execute the instructions associated with 114, 202, 608 and/or 626. In the context of this specification, a "computer readable medium" can be any means that can store, communicate, propagate, or transport the program associated with 114, 202, 608 and/or 626 for use by or in connection with the instruction execution system, apparatus, and/or device. The computer readable medium can be, for example, but not limited to, an electronic, magnetic, optical, electromagnetic, infrared, or semiconductor system, apparatus, device, or propagation medium. More specific examples (a nonexhaustive list) of the computer readable medium would include the following: an electrical connection having one or more wires, a portable computer diskette (magnetic, compact flash card, secure digital, or the like), a random access memory (RAM), a read-only memory (ROM), an erasable programmable read-only memory (EPROM, EEPROM, or Flash memory), an optical fiber, and a portable compact disc read-only memory (CDROM). Note that the computer-readable medium, could even be paper or another suitable medium upon which the program associated with 114, 202, 608 and/or 626 is printed, as the program can be electronically captured, via for instance optical scanning of the paper or other medium, then compiled, interpreted or otherwise processed in a suitable manner if necessary, and then stored in memory 110 or 606.

It should be emphasized that the above-described embodiments of the present invention are merely examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A method for compensating images, the method comprising the steps of:

receiving image data corresponding to a captured image;

sensing at least one characteristic of a sheet of paper transported by a printing system;

selecting one of a plurality of compensation data, the selected compensation data corresponding to a sensed characteristic;

receiving compensation data, the compensation data corresponding to distortion in a printed image caused by mechanical image stretch associated with at least one mechanical system;

combining the image data with the compensation data; and generating compensated image data from the combined image data and the compensation data.

2. The method of claim 1, further comprising:

communicating the compensated image data to a printing device; and generating at least one compensated raster line by compensating at least one of the generated raster lines using the compensated image data so that distortion in the printed image caused by the mechanical image stretch is reduced.

3. The method of claim 1, further comprising determining image distortion caused by the mechanical system, wherein the mechanical system resides in a paper transport unit configured to transport a printing medium in proximity to a printing unit such that the compensated raster line is printed on the printing medium.

4. The method of claim 1, further comprising determining image distortion caused by the mechanical system, wherein the mechanical system resides in a printing unit configured to print a compensated raster line on a printing medium.

5. The method of claim 1, further comprising determining image distortion caused by the mechanical system, wherein the mechanical system resides in an image capture device configured to generate the received image data.

6. The method of claim 1, further comprising determining the compensation data from at least one design parameter of the mechanical system.

7. The method of claim 1, further comprising:

printing a captured image of a reference image, the reference image having at least one reference point;

comparing a corresponding point on the printed captured image and the reference point on the reference image; and determining the compensation data from a difference between a corresponding point on the printed captured image and the reference point on the reference image.

8. The method of claim 7, wherein the reference point on the reference image comprises at least one selected from a group consisting of a known distance, a known color, a known shape, a known pattern and a known scale.

9. The method of claim 1, wherein the step of generating the compensated image data includes the step of magnifying at least a selected portion of the received image data.

10. The method of claim 1, wherein the step of generating the compensated image data includes the step of reducing at least a selected portion of the received image data.

11. The method of claim 1, wherein the sensed characteristic comprises at least one selected from a group consisting of a paper type, a friction coefficient and a paper size.

12. A method for compensating images, the method comprising the steps of:

receiving image data corresponding to a captured image;

receiving compensation data, the compensation data corresponding to distortion in a printed image caused by mechanical image stretch associated with at least one mechanical system;

combining the image data with the compensation data; and generating compensated image data from the combined image data and the compensation data, wherein receiving the compensation data and generating the compensated image data is performed for a plurality of printing systems, and wherein each printing system includes at least one unique mechanical system causing mechanical image stretch, such that the generated compensated image data is unique to each one of the plurality of printing systems.

* * * * *